US009469124B2

(12) United States Patent
Ishida

(10) Patent No.: US 9,469,124 B2
(45) Date of Patent: Oct. 18, 2016

(54) IMAGE FORMING APPARATUS

(71) Applicant: RISO KAGAKU CORPORATION, Tokyo (JP)

(72) Inventor: Mari Ishida, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/191,081

(22) Filed: Feb. 26, 2014

(65) Prior Publication Data

US 2014/0240387 A1 Aug. 28, 2014

(30) Foreign Application Priority Data

Feb. 28, 2013 (JP) ..... 2013-039505

(51) Int. Cl.
*B41J 2/045* (2006.01)
*B41J 2/21* (2006.01)

(52) U.S. Cl.
CPC ..... *B41J 2/2132* (2013.01)

(58) Field of Classification Search
USPC ..... 347/15, 11, 5
See application file for complete search history.

(56) References Cited

U.S. PATENT DOCUMENTS 8,807,685 B2 * 8/2014 Ishida ..... B41J 2/2146 347/14
8,851,770 B2 * 10/2014 Ikeda ..... B41J 3/60 399/384
2006/0066646 A1 * 3/2006 Yamanobe ..... B41J 2/2135 347/5
2011/0280642 A1 * 11/2011 Ikeda ..... B41J 3/60 400/582
2011/0285780 A1 * 11/2011 Yamada et al. ..... 347/15
2012/0075375 A1 * 3/2012 Ebisawa ..... 347/15
2014/0085370 A1 * 3/2014 Ishida ..... B41J 2/2146 347/14

FOREIGN PATENT DOCUMENTS

JP 2007-326280 A 12/2007
JP 2010-23294 A 2/2010
JP 2010-173178 A 8/2010
JP 2010-234681 A 10/2010

* cited by examiner

*Primary Examiner* — Matthew Luu
*Assistant Examiner* — Lily Kemathe
(74) *Attorney, Agent, or Firm* — Greenblum & Bernstein, P.L.C.

(57) ABSTRACT

An image forming apparatus includes: a classification unit configured to classify ink colors to be superimposedly ejected in a region with a color tone change within a color image formed on a print sheet into a reference color exempted from an ejection timing correction and a correction color subjected to the ejection timing correction, for each line, based on information on comparison between minimum drop numbers acquired by a drop number acquisition unit and information on comparison between drop number distributions acquired by a distribution acquisition unit; a correction scheme acquisition unit configured to acquire a correction scheme of the ink ejection timing of the correction color in the region, for each line; and a correction unit configured to correct the ink ejection timing of the correction color in the region with the correction scheme acquired by the correction scheme acquisition unit, for each line.

8 Claims, 9 Drawing Sheets

IMAGE FORMING APPARATUS

CROSS REFERENCE TO RELATED APPLICATION

This application is based upon and claims the benefit of priority from the prior Japanese Patent Application No. 2013-039505, filed on Feb. 28, 2013, the entire contents of which are incorporated herein by reference.

BACKGROUND

1. Technical Field

The present invention relates to an image forming apparatus including a line ink jet head having line heads of respective colors arranged at intervals in a sub-scanning direction perpendicular to a main scanning direction, each of the line heads having ink ejecting nozzles arranged in the main scanning direction.

2. Related Art

In the field of ink-jet image forming apparatuses, line ink jet printers have become popular, which can realize high-speed printing by performing image formation (printing) in a main scanning direction in a so-called one-pass operation.

This kind of ink jet printer uses line heads each having ink ejecting nozzles arranged in the main scanning direction. In an ink jet printer capable of printing in two colors or more, particularly, line heads of respective colors are arranged at intervals in a sub-scanning direction perpendicular to the main scanning direction.

A color image is formed on a print sheet by ejecting ink droplets from the nozzles of the line heads of the respective colors when the print sheet passes below the line heads while being conveyed in the sub-scanning direction.

In a color ink jet printer, a landing position shift of any of ink droplets of two colors or more, which are intended to land at the same pixel position on the print sheet, causes a problem of changing the color of the pixel from its originally-intended color tone. Also, it has been known that a landing position shift amount of each ink droplet varies due to a difference in the number of ink drops ejected from the nozzles, and such a variation generates a portion with a color tone change within an image, resulting in deterioration of image quality (see Japanese Unexamined Patent Application Publication No. 2010-173178).

In order to prevent deterioration of image quality attributable to a difference in the number of ink drops ejected, it has been proposed to individually correct the ink ejection timing for each nozzle in accordance with the number of ink drops to be ejected from the nozzle (see Japanese Unexamined Patent Application Publication No. 2010-173178).

SUMMARY

However, in order to correct the ink ejection timing for each nozzle, the nozzles have to include individual drive units. This complicates not only a circuit configuration but also matters to be controlled. Moreover, in the case of color printing, correction of the ejection timing needs to be performed for each of the nozzles of colors in a superimposed color with a color tone change caused by a landing position shift. This further increases the complexity.

It is an object of the present invention to provide an image forming apparatus capable of inhibiting a color tone change of a superimposed color in color printing due to a landing position shift without individual control on ink ejection for each of nozzles of each color.

An image forming apparatus in accordance with some embodiments includes: line heads for respective colors arranged in a sub-scanning direction, each of the line heads having a plurality of nozzles arranged in a main scanning direction perpendicular to the sub-scanning direction, and configured to allow ink ejected from nozzles of the plurality of nozzles to superimposedly land on a print sheet conveyed in the sub-scanning direction to forma color image on the print sheet; a drop number acquisition unit configured to acquire a minimum drop number of ink ejected in a region with a color tone change within the color image formed on the print sheet, for each line and for each color of the ink ejected in the region, based on image data of the color image; a distribution acquisition unit configured to acquire a drop number distribution of the ink ejected on a line belonging to the region, for each line and for each ink color, based on the image data; a classification unit configured to classify ink colors to be superimposedly ejected in the region into a reference color exempted from an ejection timing correction and a correction color subjected to the ejection timing correction, for each line, based on information on comparison between the acquired minimum drop numbers of the ink colors and information on comparison between the acquired drop number distributions of the ink colors; a correction scheme acquisition unit configured to acquire a correction scheme of the ink ejection timing of the correction color in the region, for each line; and a correction unit configured to correct the ink ejection timing of the correction color in the region with the correction scheme acquired by the correction scheme acquisition unit, for each line.

DETAILED DESCRIPTION

Figure 1:
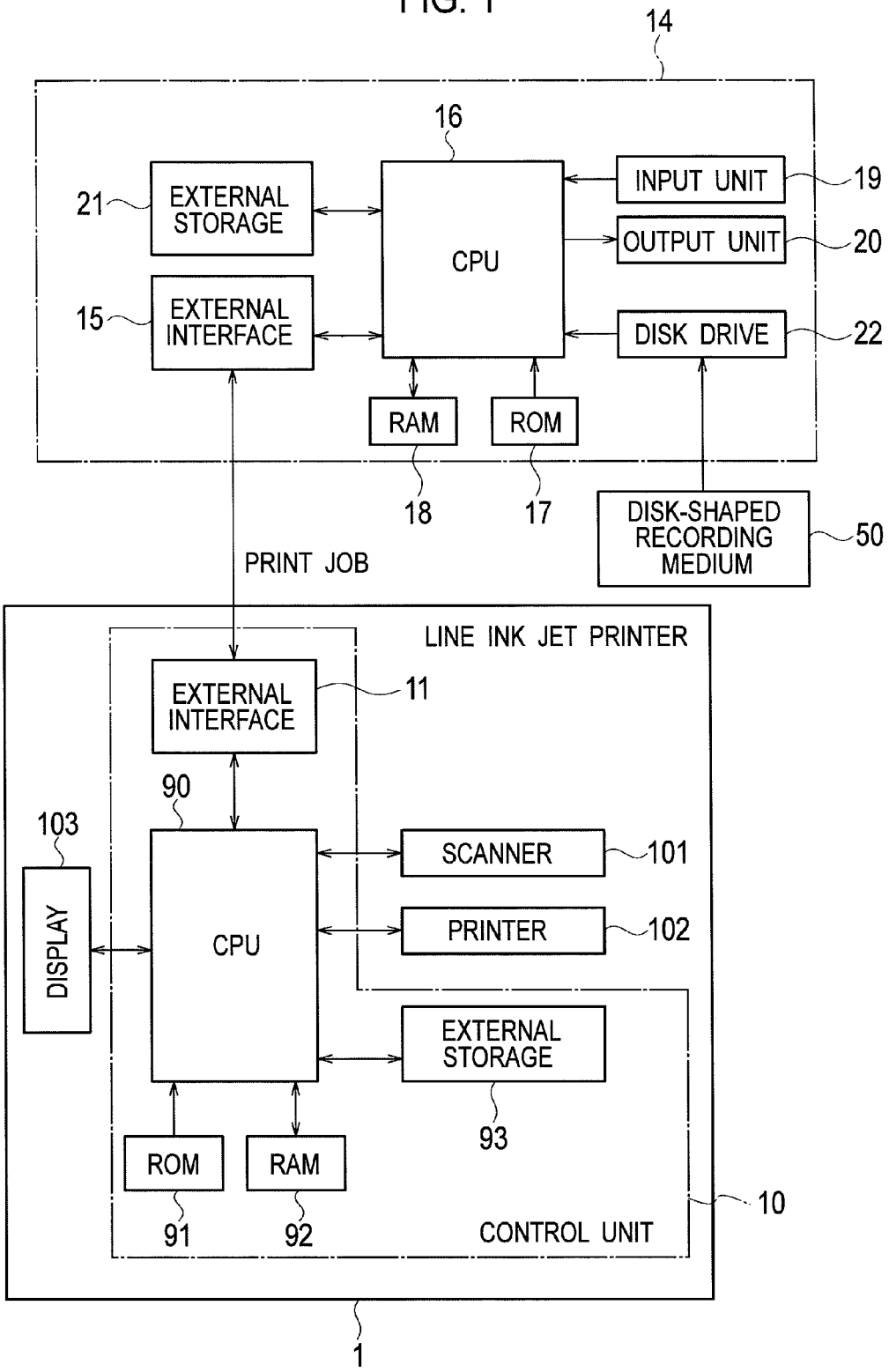
FIG. 1 is an explanatory diagram showing a schematic configuration of a line inkjet printer to which an embodiment of the present invention is applied and a control system thereof.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

With reference to the drawings, an embodiment of the present invention will be described below. Note that, throughout the drawings, the same or similar parts or constituent elements will be denoted by the same or similar reference numerals, and description thereof will be omitted or simplified FIG. 1 is an explanatory diagram showing a schematic configuration of a line ink jet printer to which the embodiment of the present invention is applied. As shown in FIG. 1, a line ink jet printer (image forming apparatus) (hereinafter abbreviated as the "ink jet printer") 1 of this embodiment includes: a scanner 101 configured to read an original image on an original and output an image signal; a printer 102 configured to print (record) the original image on a print sheet S (one side or both sides, see FIG. 2) based on the image signal outputted from the scanner 101; a display 103 for various display inputs; and a control unit 10 for overall control.

Figure 2:
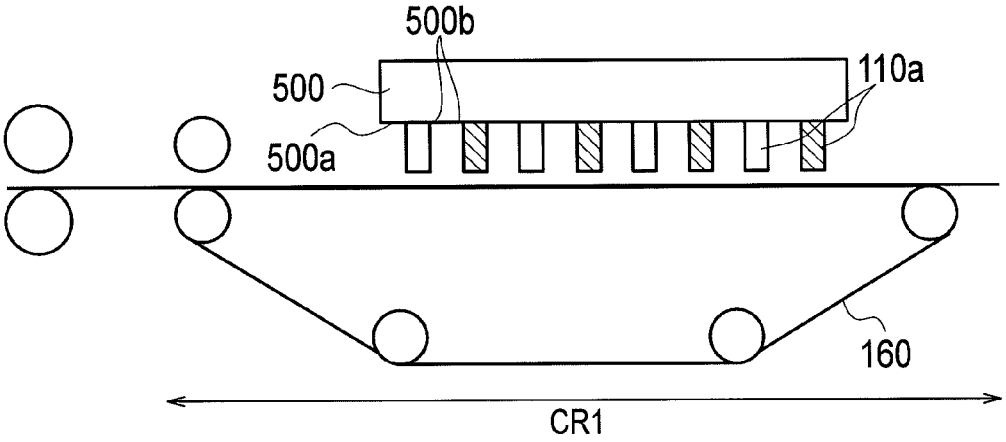
FIG. 2 is an explanatory diagram showing, from the side, an image formation route of a printer shown in FIG. 1.
Figure 3A:
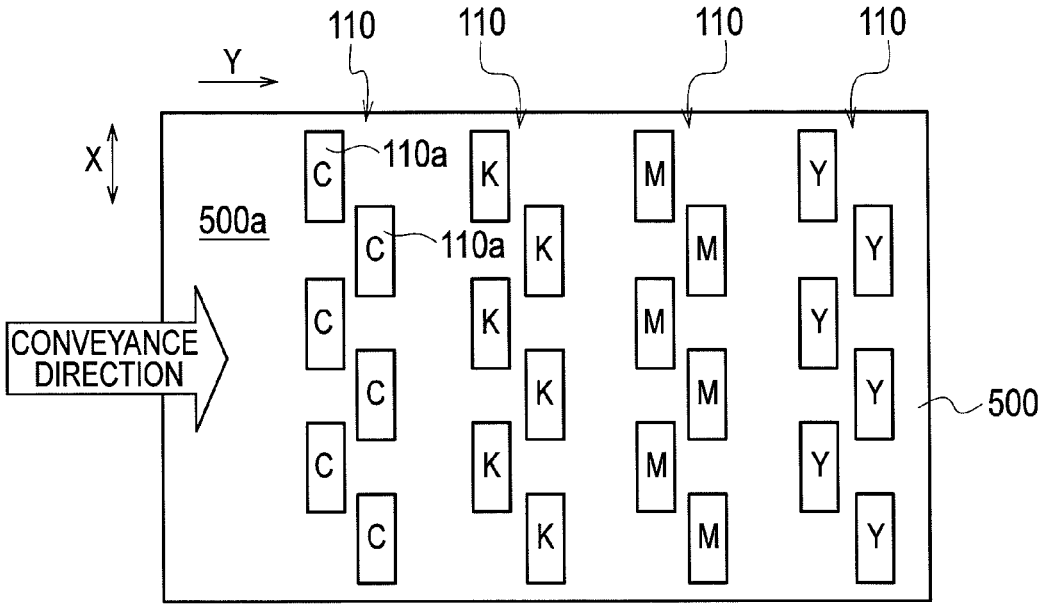
FIG. 3A is an explanatory diagram showing a head holder shown in FIG. 2 from below.
Figure 3B:
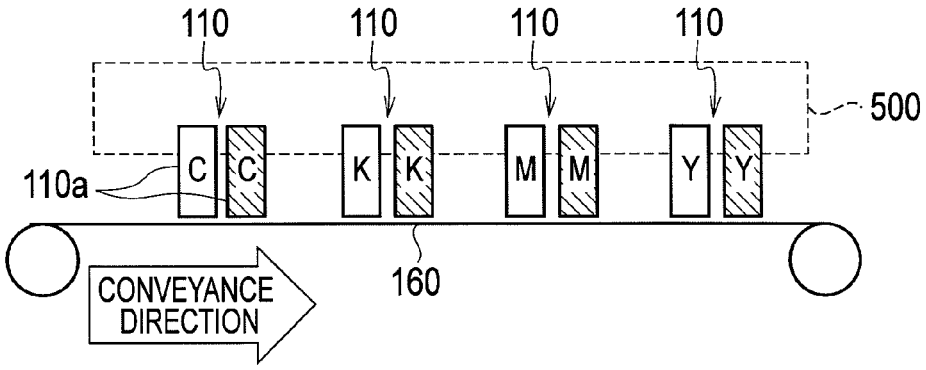
FIG. 3B is an explanatory diagram showing an enlarged cross section of the head holder shown in FIG. 2.

FIG. 2 is an explanatory diagram showing an image formation route CR1 from the side, through which image formation is performed by the printer 102 in the ink jet printer 1 according to this embodiment. FIG. 3A is an explanatory diagram showing a head holder 500 in FIG. 2 from below, which is disposed above the image formation route CR1. FIG. 3B is an explanatory diagram showing an enlarged cross section of the head holder 500.

The printer 102 in the ink jet printer 1 according to this embodiment includes line heads 110 as image formation units for respective colors. As shown in FIG. 3A, the line heads 110 of the respective colors are extended along a main scanning direction X and disposed so as to be equally spaced apart in a sub-scanning direction Y. Also, the line head 110 of each color is configured by arranging head blocks 110*a* in the main scanning direction X.

As shown in FIG. 2, the printer according to this embodiment includes the image formation route CR1 as a conveyance route. On the image formation route CR1, the print sheet S is conveyed by a conveyance belt 160 in the sub-scanning direction Y at a speed specified by print conditions. Above the image formation route CR1, the line heads 110 of the respective colors are disposed so as to face the conveyance belt 160. Inks of the respective colors are ejected line by line (in the unit of line head 110) from nozzles in the head blocks 110*a* of the line heads 110 onto the print sheet S on the conveyance belt 160, thereby forming images superimposed one on another.

As shown in FIGS. 3A and 3B, a number of the head blocks 110*a* are provided for each of the colors, C (cyan), K (black), M (magenta) and Y (yellow). The head blocks 110*a* of the respective colors are disposed so as to be equally spaced apart in the sub-scanning direction Y. The head blocks 110*a* of each of the colors are arranged in the main scanning direction X while being alternately shifted in position in a conveyance direction. Thus, the interval between the nozzles (not shown) at edges of two adjacent head blocks 110*a* coincides with the interval between the adjacent nozzles in each head block 110*a*.

Each of the head blocks 110*a* can change the number of ink drops to be ejected. The number of drops (the number of droplets) to be ejected changes dot density. Note that the ink jet printer 1 of this embodiment includes a function to adjust a drop size as a droplet amount. The adjustment of the droplet amount in each of the head blocks 110*a* can be performed by adjusting a drive voltage of the head block 110*a*.

Here, there is a case where ink droplets of two or more colors from corresponding nozzles of the head blocks 110*a* of the respective colors form a superimposed color by superimposedly landing on the same pixel position of the print sheet S. In this event, an influence of an airflow caused by the conveyance of the print sheet S or the like may cause a landing position shift of any of the ink droplets of the two colors, resulting in a color tone change of the pixel from its original color to a different color. Particularly, the ink with a small number of drops is light and therefore is likely to flow under the influence of the airflow. Accordingly, a landing position shift thereof tends to be large.

Figure 4A:
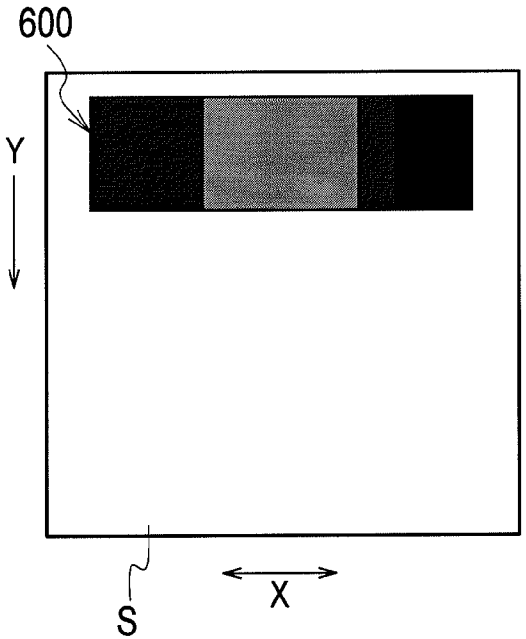
FIG. 4A is an explanatory diagram of a color image with superimposed colors formed on a print sheet shown in FIG. 1.

Here, with reference to FIGS. 4A to 4C, description will be given of a color tone change that occurs when a color image containing superimposed colors is formed on the print sheet S. For example, when a color image 600 shown in FIG. 4A is formed with superimposed colors of cyan (C) and magenta (M), the inks are ejected from the nozzles of the respective line heads 110 of cyan (C) and magenta (M) with drop number distributions (a drop number distribution width of cyan=1 and a drop number distribution width of magenta=5) as shown in the upper and lower parts of FIG. 4B. Note that, in FIG. 4B, a left and right direction is the main scanning direction and a top and bottom direction is the sub-scanning direction.

Figure 4B:
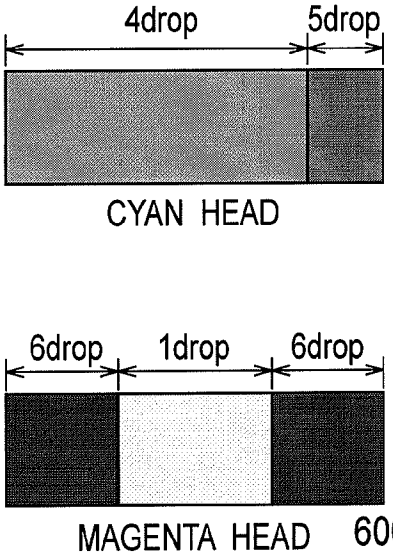
FIG. 4B is an explanatory diagram showing distributions of the number of drops ejected from nozzles in line heads of cyan and magenta which are colors superimposed in the color image shown in FIG. 4A.
Figure 4C:
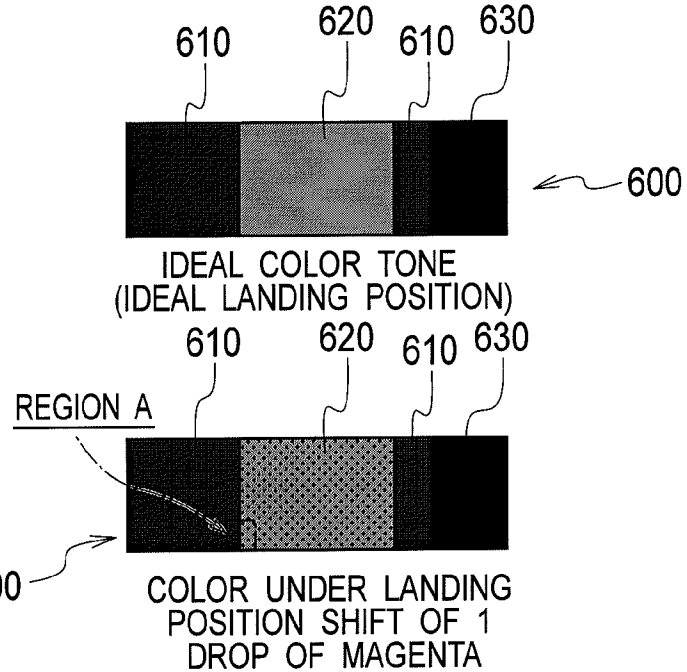
FIG. 4C is an explanatory diagram showing how the color tone is changed from an ideal color tone due to a landing position shift.

When the inks of cyan (C) and magenta (M) are ejected from the respective nozzles with the distributions shown in FIG. 4B, a superimposed color region 610 with four drops of cyan and six drops of magenta, a superimposed color region 620 with four drops of cyan and one drop of magenta, a superimposed color region 610 with four drops of cyan and six drops of magenta, and a superimposed color region 630 with five drops of cyan and six drops of magenta are formed from the left side of FIG. 4C as shown in the upper part of FIG. 4C in the color image 600 formed on the print sheet S.

When the cyan (C) and magenta (M) inks land at ideal positions, respectively, a superimposed color of cyan (C) and magenta (M) is printed with a color tone corresponding to the numbers of drops of the two colors in each of the regions 610 to 630 as shown in the upper part of FIG. 4C. However, a landing position shift of the cyan (C) or magenta (M) ink may change the size of the superimposed portion of the both inks, resulting in a color tone change of the color image 600.

Here, a landing position shift amount of each ink may vary depending on the number of drops of the ink. For example, when the landing position of the magenta (M) ink shifts, the degree of color tone change may vary between the region 620 where one drop of ink lands and the regions 610 and 630 where six drops of ink land. Note that the lower part of FIG. 4C shows a case where a notable color tone change to a reddish tone occurs in the region 620.

A landing position shift of the ink, which causes such a color tone change, can be inhibited by correcting (advancing or delaying) ejection timing of the ink. In this embodiment, the ejection timing for a certain one of multiple colors of inks included in a superimposed color is not corrected because this color is used as a reference color. The ejection timing is corrected for the other remaining colors as correction colors. Thus, landing positions of the other colors are adjusted with respect to the landing position of the reference color, and thereby such a color tone change is inhibited.

In this case, as described above, a landing position shift of ink may vary depending on the number of drops of the ink. Therefore, it is conceivable that ink ejection timing from each of the nozzles in the line heads 110 of magenta (M) is corrected with a scheme corresponding to the number of drops to be ejected from the nozzle. However, when an independent drive circuit is provided for each of the nozzles according to the number of ink drops to be ejected from each nozzle, a circuit configuration is increased in size. Moreover, the load on a control system is also increased since the respective drive circuits are individually controlled.

To avoid such a problem, in the ink jet printer 1 of this embodiment, an ink color, for which ink ejection timing is to be corrected, and a correction scheme is determined according to the minimum number of drops of each color of ink to be ejected on a pixel with a color tone change of inks included in a superimposed color and a drop number distribution of ink to be ejected from the nozzles in the line heads 110 of each color onto one line of pixels in the main scanning direction X including the pixel with a color tone change. Then, ejection timing of the ink to be ejected from each of the nozzles in the line heads 110 of the color to be corrected is uniformly corrected for each of the line heads 110 by the control unit 10 using the determined correction scheme.

As shown in FIG. 1, an external interface 15 of a client terminal 14 to be described later is connected to the control unit 10 through an external interface 11. A 100 BASE-TX cable LAN, for example, is used for such connection. The control unit 10 receives a print job for an original image from the client terminal 14. This print job includes postscript data and print environment data. The control unit 10 generates raster data on the original image from the postscript data included in the received print job. The ink jet printer 1 allows the printer 102 to execute printing of the original image on the print sheet S under the conditions specified in print environment information on the print job.

The control unit 10 in the ink jet printer 1, which instructs the printer 102 described above to perform a print operation includes a CPU 90. The display 103 is connected to the CPU 90. The display 103 can be used as an input operation unit for a user to select and input a menu, such as conversion of a read image into electronic data and self-diagnosis, when the ink jet printer 1 is used in a scanner mode in which an image is read from the print sheet S by the scanner 101.

The CPU 90 in the control unit 10 controls operations of the scanner 101 and the printer 102 according to conditions inputted and set from the display 103, based on programs and setting information stored in a ROM 91.

Note that a RAM 92 is provided in the control unit 10, and the RAM 92 stores, as needed, details of menu selection and the like inputted from the display 103. Also, a frame memory region is provided in the RAM 92. In the frame memory region, the raster data on the original image, which is generated by the CPU 90 from the postscript data included in the print job inputted to the control unit 10 from the client terminal 14, is temporarily stored until the raster data is outputted to the printer 102.

Moreover, an external storage 93 is provided in the control unit 10. The external storage 93 stores firmware of the display 103, a printer engine of the printer 102 and the scanner 101 in separate areas, respectively.

Furthermore, the external storage 93 (storage unit) stores correction profile data to correct ink ejection timing from the nozzles. The correction profile data is profile data used to correct ink ejection timing from nozzles, which is described in Japanese Patent Application Publication No. 2010-23294 or No. 2010-234681. See the description of each publication for more details.

The correction profile data is used to avoid a landing position shift of each color of ink landing on the same pixel. A correction scheme defined by the correction profile data can be determined based on a measured rotation distance of the conveyance belt 160 from its home position at each ejection timing of each color of ink, and a detail of a landing position shift from an ideal landing position of each color of ink, for example.

The detail of the landing position shift from the ideal landing position of each color of ink is defined for each combination pattern of the numbers of ink drops of the respective colors ejected onto a target pixel. Therefore, the correction profile data is provided for each combination pattern of the respective colors of ink ejected onto the target pixel.

For example, when the number of ink drops to be ejected from the nozzles changes in eight stages of 0 to 7 drops, 8^4 (the fourth power of eight)=4096 kinds of correction profile data are stored in the external storage 93.

Note that it is preferable to provide the correction profile data for each type of the print sheet S. When the type of the print sheet S is changed, a dot gain is changed. As in the case of a change in the number of drops, how the landing position shifts is changed, and thus what color tone change to occur is changed.

The correction profile data can be acquired for each ink jet printer 1 before shipping of the ink jet printer 1, for example, and stored in the external storage 93. An ejection timing correction amount of ink droplets to be ejected from the nozzles in the line head 110, as a content of the correction profile data, can be acquired for each color from a print result of a test pattern image on the actual print sheet S.

Moreover, the correction profile data may be updated in case of a new event that changes a landing position shift pattern of ink droplets of each chromatic color, such as replacement of the head blocks 110*a* or the image formation route CR1.

The client terminal 14 is configured using a PC (personal computer) or the like, and includes a CPU configured to execute various kinds of processing based on a control program stored in a ROM 17, a RAM 18 configured to function as a working area of the CPU 16, an input unit 19 configured using a keyboard, a mouse and the like, and an output unit 20 configured using a liquid crystal display or the like.

Besides the external interface 15 described above, an external storage 21 and a disk drive 22 are connected to the CPU 16. In the external storage 21, storage areas of various data, programs and original image data, and the like are secured.

The CPU 16 starts an application program of the external storage 21, and generates a print job of an original image to be printed when a print command is inputted for the original image data in the external storage 21, for example. Then, the CPU 16 outputs the generated print job to the external interface 11 in the control unit 10 from the external interface 15. The print job can be outputted to the control unit 10 by the CPU 16 executing a printer driver program stored in the external storage 21.

Also, the CPU 16 can read various programs or data from a disk-shaped recording medium 50 such as an optical disk by the disk drive 22 in the client terminal 14, and install (store) such programs or data in the external storage 21 or transmit such programs or data to the ink jet printer 1.

Figure 5:
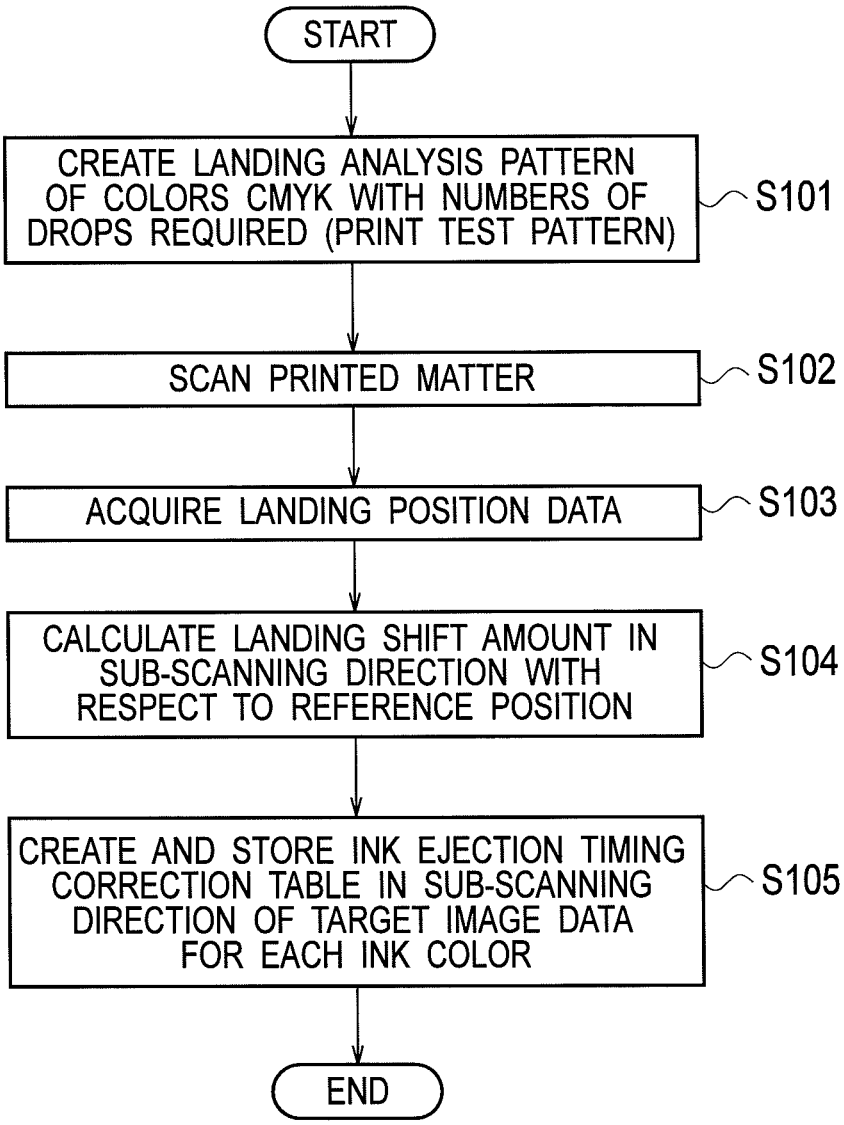
FIG. 5 is a flowchart showing procedures for generating correction profile data in an external storage shown in FIG. 1.

Next, description will be given of profiling procedures for the correction profile data in the external storage 93, i.e., procedures for generating profile data. FIG. 5 is a flowchart showing the procedures for generating the profile data.

To generate correction profile data, first, in Step S101 in FIG. 5, a test pattern to detect a landing position shift of each pixel is printed by the ink jet printer 1.

There are different types (8^4 (the fourth power of eight) =4096 types) of test patterns for every combination of the numbers of drops. In each of the test patterns, dots are formed by ink droplets of respective colors, cyan (C), black (K), magenta (M) and yellow (Y), which are ejected for specified numbers of drops from corresponding nozzles to all the pixels across the entire print sheet S.

Figure 6:
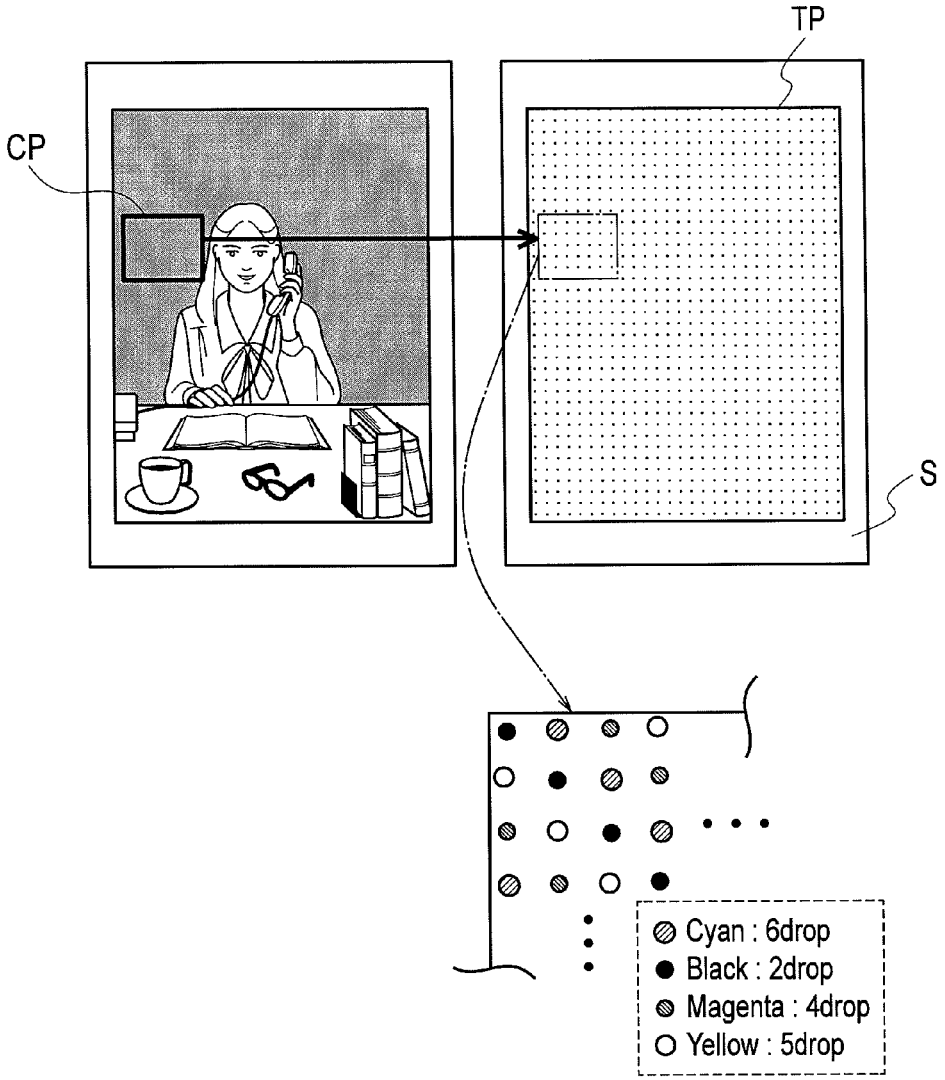
FIG. 6 is an explanatory diagram showing what is a test pattern printed by the ink jet printer shown in FIG. 1.

FIG. 6 is an explanatory diagram showing an example of a test pattern printed by the ink jet printer 1. In FIG. 6, TP represents a test pattern and CP represents a correction portion. An analysis pattern (enlarged view) of landing positions in a portion of the test pattern TP corresponding to the correction portion CP is shown in the lower right of FIG. 6. The test pattern is to identify landing position shifts of the respective colors of ink on the pixels in the correction portion extracted from the original image including a picture shown in the upper left of FIG. 6. In the test pattern, C (cyan), K (black), M (magenta) and Y (yellow) are sequentially printed in single color in the pixels on the print sheet S, so that landing position shifts in ink droplets landing on the pixels in the correction portion can be identified for each of the colors. Note that FIG. 6 shows, as an example, a test pattern with a combination of six drops of C (cyan), two drops of K (black), four drops of M (magenta) and five drops of Y (yellow), which land on the pixels in the correction portion.

Next, in Step S102 in FIG. 5, the test pattern is read by the scanner 101. Then, in Step S103, the image data is analyzed by the control unit 10 to acquire dot landing positions in the respective pixels on the test pattern image. Thereafter, a landing position shift (in the sub-scanning direction Y) in each pixel is calculated by comparison with a normal landing position in each pixel on the print sheet S, which is previously recognized by the control unit 10 (Step S104).

Subsequently, correction profile data is generated, which defines a correction value of ejection timing of each color of ink to avoid the landing position shift of each color of ink with respect to the normal landing position. Then, the correction profile data is stored in the external storage 93 as correction profile data corresponding to a combination of the numbers of drops of the respective colors of ink printed in the test pattern (Step S105).

After performing the above steps for the combination patterns of the numbers of drops of the respective colors of ink, a series of procedures are terminated.

Next, with reference to flowcharts of FIGS. 7 and 8, description will be given of procedures for determining a correction scheme of ink ejection timing by the control unit 10 in printing of a color image on the print sheet S by the ink jet printer 1.

First, the control unit 10 determines a region and an ink color subjected to ink ejection timing correction in printing the color image on the print sheet S. To be more specific, as shown in FIG. 7, the control unit 10 allows the scanner 101 to read the color image printed on the print sheet S as a sample to determine a target region and a target ink color for ejection timing correction (Steps S111 and S112).

The sample is acquired by test-printing only one sheet, when the control unit 10 receives a print job from the client terminal 14, before actual printing of the color image by executing the print job. Here, the color image 600 that has turned reddish as shown in the lower part of FIG. 4C is read by the scanner 101 from the test-printed print sheet S.

Then, the control unit 10 extracts a region with a notable color tone change of a superimposed color, as a portion needing landing position shift correction, by comparison between image data on the read color image 600 and image data on the color image 600 in the print job (Step S113).

To be more specific, for example, a color tone of a superimposition of cyan and magenta on the data (on the color image 600 in the print job) is compared with a color tone of a superimposition of cyan ink and magenta ink actually formed on the print sheet S. Then, a region with the largest difference in color tone therebetween is extracted as the portion needing the landing position shift correction from among image portions formed by the ink ejected from the nozzles in one of the line heads 110. In the case of the color image 600 shown in the lower part of FIG. 4C, the region 620 with a notable color tone change turning reddish due to a shift in magenta, for example, is extracted as the portion needing the landing position shift correction.

After the extraction of the portion needing the landing position shift correction on the print sheet S as described above, the control unit 10 next determines, for each line, ink ejection timing correction scheme to be applied in actual printing of the color image on the print sheet S by executing the print job received from the client terminal 14. The ejection timing correction scheme for each line are applied to correct a landing position shift in a line corresponding to the extracted portion.

Figure 8:
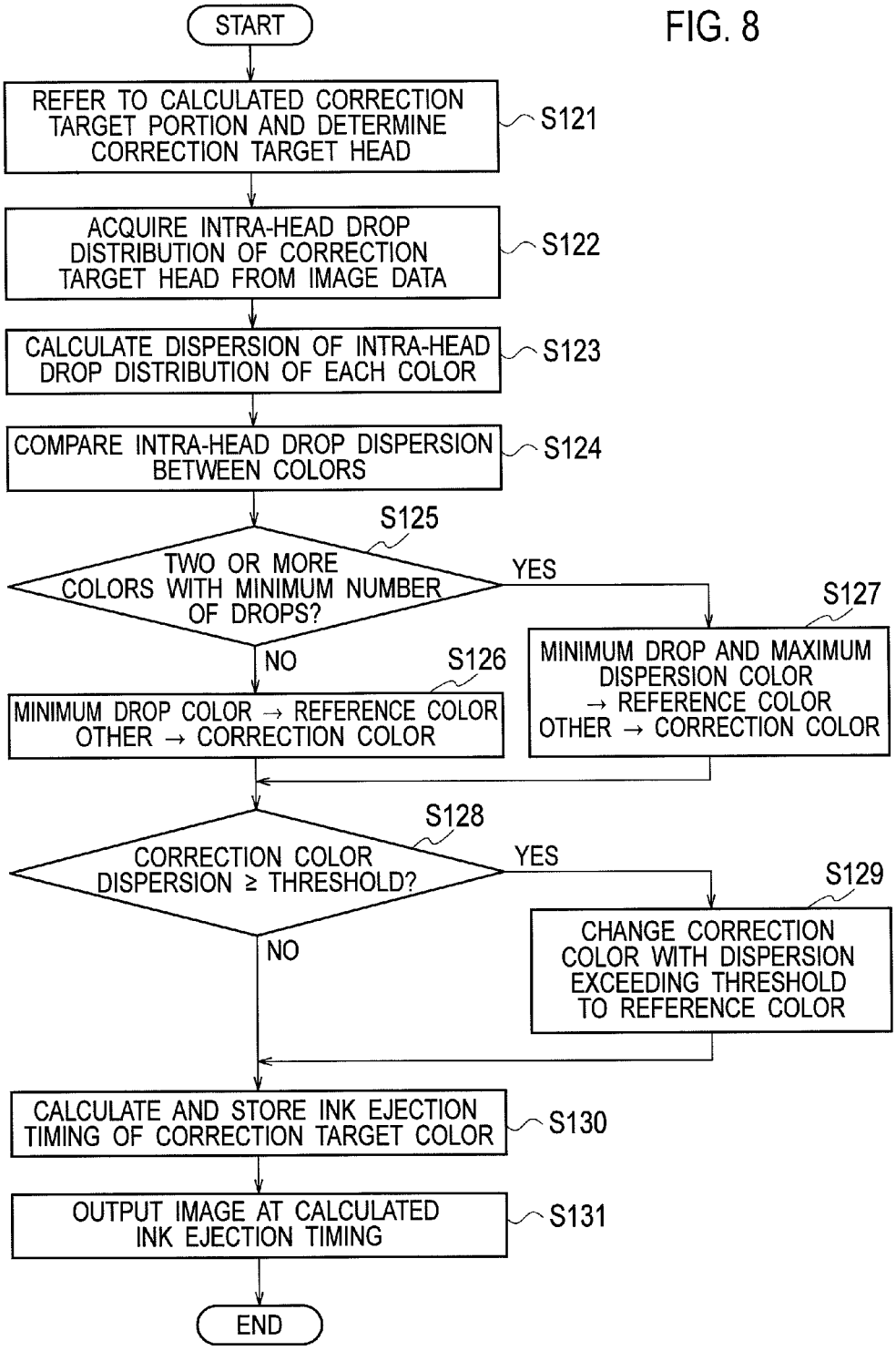
FIG. 8 is a flowchart showing procedures for determining correction scheme for the portion needing landing position shift correction, which is extracted by the control unit shown in FIG. 1.

The determination described above is made by repeating the procedures of Steps S121 to S130 in FIG. 8 for each line in the main scanning direction X of the color image. Then, in actual printing, the color image is printed on the print sheet S by correcting the ink ejection timing of each line using the determined correction scheme (Step S131).

Figure 7:
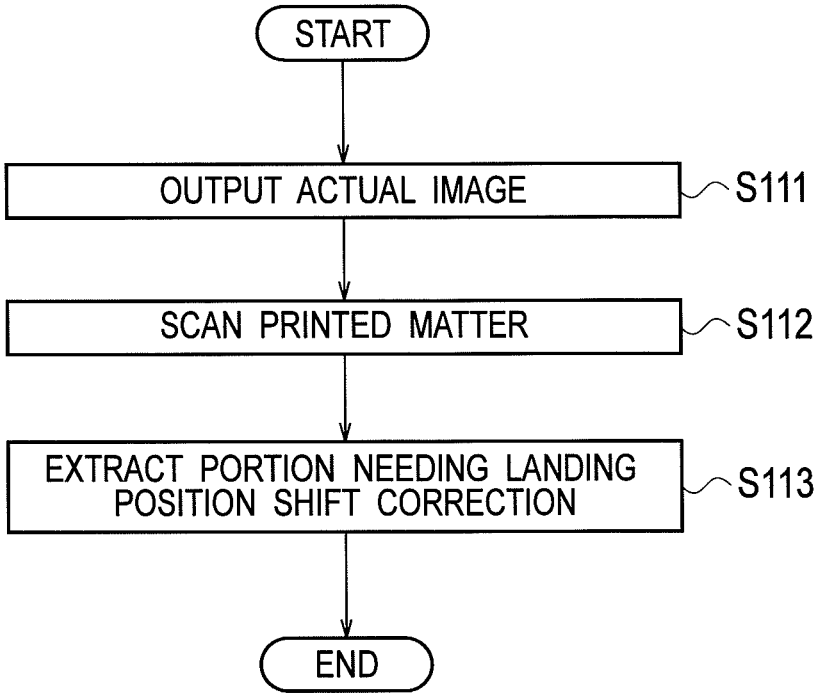
FIG. 7 is a flowchart showing procedures for extracting a portion needing landing position shift correction from an actually printed color image by a control unit shown in FIG. 1.

More specifically, the control unit 10 determines, for each line in the main scanning direction X, a correction target head to be subjected to ink ejection timing correction to correct a landing position shift, by referring to the portion needing the landing position shift correction, which is extracted in Step S113 of FIG. 7 (Step S121). To be more specific, when the size of the portion needing the landing position shift correction takes a certain value or more in ratio to the size of the print sheet S, the line heads 110 of the colors included in a superimposed color formed in the portion are determined as the correction target heads for each line.

For example, as shown in the lower part of FIG. 4C, in the case of the color image 600 in which the region 620 that has turned reddish is extracted as the portion needing the landing position shift correction, the line heads 110 corresponding to cyan and magenta are determined as the correction target heads for each line in the main scanning direction X corresponding to the color image 600. Each of the ink colors corresponding to the determined correction target heads is set as a reference color exempted from ink ejection timing correction or a correction color subjected to the correction, as described later.

Subsequently, the control unit 10 acquires, from the print job from the client terminal 14, the number of ink drops to be ejected onto the pixels in the portion needing the landing position shift correction from the nozzles of the line heads 110 determined as the correction target heads as well as a drop number distribution of the ink to be ejected by the nozzles of the line heads 110 onto one line of pixels in the main scanning direction X including those pixels (Step S122).

Then, the control unit 10 calculates dispersion of the drop number distribution of the ink ejected from the nozzles in the line heads 110 of the respective colors included in superimposed color, based on the acquired drop number distribution, for each line in the main scanning direction X (Step S123). Then, the control unit 10 compares the drop number distribution dispersion between the colors (Step S124). Thereafter, the control unit 10 checks if there are two or more colors of inks with the minimum number of ink drops to be ejected onto the pixels in the portion needing the landing position shift correction from the nozzles of the line heads 110 of the respective colors for each line in the main scanning direction (Step S125).

When there is only one color (NO in Step S125), the control unit 10 sets the color of the ink with the minimum number of drops to be ejected onto the pixels in the portion needing the landing position shift correction for the line as a reference color exempted from the ejection timing correction, and sets the other color as a correction color subjected to the ejection timing correction (Step S126). On the other hand, when there is more than one color of ink with the minimum number of ink drops to be ejected onto the pixels in the portion needing the landing position shift correction (YES in Step S125), the control unit 10 sets the color with the largest drop number distribution dispersion, among the colors with the minimum number of drops, as the reference color, and sets the other color as the correction color for the line (Step S127).

Figure 9:
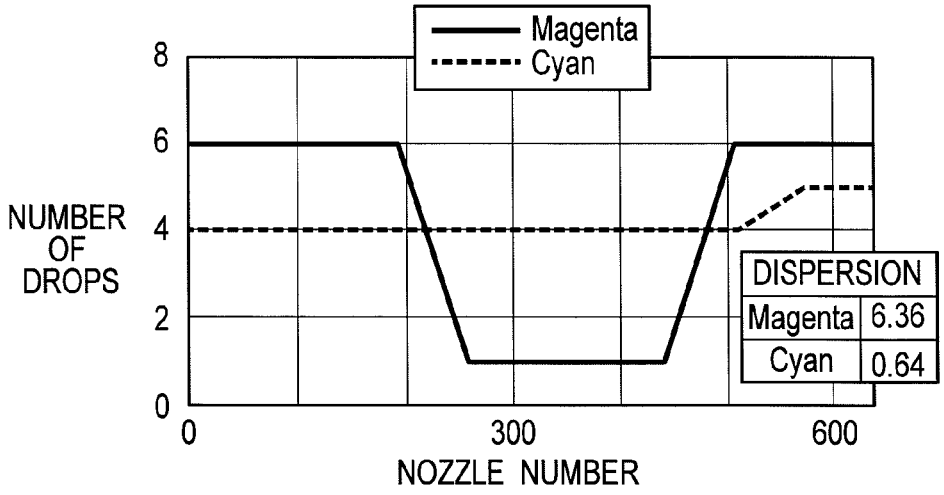
FIG. 9 is a graph showing ejection drop number distributions of cyan and magenta shown in FIG. 4B.

FIG. 9 is a graph showing drop number distributions of the inks ejected from the nozzles in the cyan and magenta line heads 110, shown in FIG. 4B, in printing the color image 600. As shown in FIG. 9, the drop number distribution is dispersed in the magenta line head 110 compared with cyan. The value of the drop number dispersion for cyan is 0.64, whereas the value of the drop number dispersion for magenta is 6.36.

Moreover, the number of ink drops (the minimum number of drops) ejected onto the pixels corresponding to the region 620 with a notable color tone change turning reddish as shown in the lower part of FIG. 4C is one for magenta, which is smaller than four for cyan. In the region 620, no black or yellow ink is ejected. For this reason, in this case, magenta with the small number of drops to be ejected (one) and large dispersion (6.36) is set as the reference color, and cyan is set as the correction color.

Note that, when there are distributions in the number of ink drops of the respective colors to be ejected onto the pixels in the region 620, the smallest number of drops (the minimum number of drops) thereamong is used as the number of drops in determination of the reference color or correction color.

The reason why the reference color and the correction color are determined as described above is as follows. Specifically, the ink ejection timing of the ink color determined as the correction color among the ink colors included in the superimposed color is corrected, for each line in the main scanning direction X, with the correction scheme corresponding to the respective drop numbers of the reference color and the correction color in the region 620 with a color tone change. Therefore, for a line belonging to the region 620, even though the pixels are some of those in the main scanning direction X, the ink ejection timing of the correction color is uniformly corrected, for all the pixels on the line, with the correction scheme corresponding to the ink drop number of the correction color for the pixels with a color tone change of the superimposed color.

More specifically, for the pixels (the pixels in the regions 610 and 630) other than the pixels (the pixels in the region 620) with a color tone change of the superimposed color, there is a difference in the number of drops between the correction color corresponding to the correction scheme of the ejection timing applied to the pixels and the correction color ejected from the nozzles onto the pixels.

Here, as is clear from the fact that the correction scheme of the ink ejection timing vary depending on the number of drops, an appropriate ejection timing which enables the ink to land at ideal landing positions varies depending on the number of ink drops, in a precise sense. Therefore, the larger the difference between the number of drops corresponding to the correction scheme applied to the pixels and the number of drops to be actually ejected onto the pixels, the larger the degree of a color tone change of the pixels other than those in the region 620 by correcting the ink ejection timing of the correction color.

Moreover, when the ink color with a large drop number distribution on the line is set as the correction color, more pixels with a large difference in the drop number described above are included in the other pixels. In the case of the pixels in the region 620, for example, the case where magenta having a larger drop number distribution than cyan is set as the correction color corresponds to such a situation (the drop number distribution width of cyan=1 and the drop number distribution width of magenta=5).

In this embodiment, the ejection timing of all the nozzles in one of the line heads 110 is corrected with the same correction scheme, rather than correcting the ejection timing with different correction schemes for the respective nozzles. Accordingly, the correction for a line head 110 which has a smaller dispersion of the drop number distribution of the ink to be ejected from the nozzles results in a small overall color tone change due to a landing position shift in each line.

Figure 10:
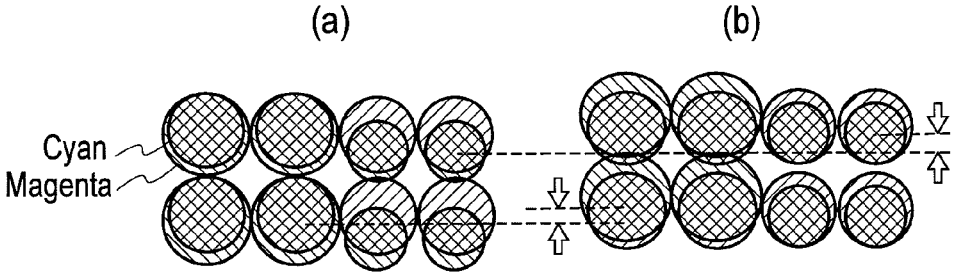
FIGS. 10(*a*) and 10(*b*) are explanatory diagrams showing, in close-up, landing positions in pixels in region A shown in the lower part of FIG. 4C, before and after correction of ejection timing when cyan is used as a reference color and magenta is used as a correction color.

FIGS. 10(*a*) and 10(*b*) show, in close-up, the pixels in region A shown in the lower part of FIG. 4C. In this case, a color tone change caused by shifts in landing positions of the cyan and magenta inks as shown in the pixels in the right two columns in FIG. 10(*a*) is corrected by shifting the landing positions of the magenta ink by a distance indicated by the white arrows with respect to the landing positions of the cyan ink as shown in the pixels in the right two columns in FIG. 10(*b*).

As a result, although the landing positions of magenta have nearly entirely overlapped with the landing positions of cyan, the landing positions of magenta do not overlap with the landing positions of cyan in a part of the lower side, as shown in the pixels in the left two columns in FIG. 10(*b*). Thus, even though a color tone change in the pixels in the right two columns in FIG. 10(*b*) is inhibited, a new color tone change occurs in the pixels in the left two columns in FIG. 10(*b*).

For this reason, it is preferable that the ink color with a relatively small drop number distribution on each line, among the colors of ink included in a superimposed color, be set as the correction color. In the case of the pixels in the region 620, for example, it is preferable that cyan having a smaller drop number distribution than magenta be set as the correction color, and magenta be set as the reference color.

Figure 11:
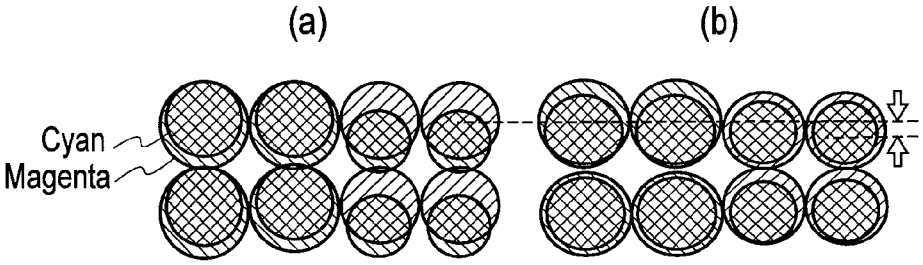
FIGS. 11(*a*) and 11(*b*) are explanatory diagrams showing, in close-up, landing positions in pixels in region A shown in the lower part of FIG. 4C, before and after correction of ejection timing when cyan is used as the correction color and magenta is used as the reference color.

FIGS. 11(*a*) and 11(*b*) show, in close-up, the pixels in region A shown in the lower part of FIG. 4C. In such a case, a color tone change caused by shifts in landing positions of the cyan and magenta inks as shown in the pixels in the right two columns in FIG. 11(*a*) is corrected by shifting the landing positions of the cyan ink by a distance indicated by the white arrows with respect to the landing positions of the magenta ink as shown in the pixels in the right two columns in FIG. 11(*b*).

Then, as shown in the pixels in the left two columns in FIG. 11(*b*), the landing positions of cyan are moved from the lowermost side to the uppermost side of the landing positions of magenta, but are maintained in a state of nearly entirely overlapping with the landing positions of magenta. Thus, a new color tone change, which is caused in the left two columns in FIG. 11(*b*) even if a color tone change of the pixels in the right two columns in FIG. 11(*b*) is inhibited, is not as large as that of the pixels in the left two columns in FIG. 10(*b*).

Note that, when the ink landing positions are adjusted by correcting the ink ejection timing, the ink with a large drop number is less likely to be influenced by the airflow around the nozzles than that with a small drop number. Thus, the ink landing positions can be surely adjusted for the ink with a large drop number. For this reason, it is advantageous that, among the ink colors included in a superimposed color, the ink color with a smaller minimum drop number be set as the reference color and the ink color with a larger minimum drop number be set as the correction color.

In other words, in this embodiment, as described above, the ejection timing of all the nozzles in one of the line heads 110 is corrected with the same correction scheme, rather than correcting the ejection timing with different correction schemes for the respective nozzles. For this reason, for the ink color with a larger number of ink drops to be ejected from the nozzles in the line head 110, the ink landing positions can be effectively controlled by correcting the ejection timing.

This means that the ink color having a larger minimum number of ink drops to be ejected from the nozzles in the line head 110 has the largest number of drops to be ejected from the nozzles in the line head 110. Therefore, it can be said that the ink color with a larger minimum drop number is suitable as the correction color and the ink color with a smaller minimum drop number is suitable as the reference color rather than the correction color.

Consequently, in determining the reference color and the correction color through the procedures up to Step S127 of the flowchart shown in FIG. 8, magenta having a small ink ejection drop number (one drop), for the pixels in the region 620 with a color tone change of a superimposed color, is set as the reference color, and cyan having a large ejection drop number (four drops) is set as the correction color.

As a result, even when the ink ejection timing is corrected with the same correction scheme for the pixels on each line, the correction can inhibit a landing position shift between the ink colors included in a superimposed color, which would result in a color tone change of the superimposed color. Moreover, also for the other pixels on the same line with no color tone change of the superimposed color, a large color tone change due to the correction of the ejection timing can be prevented.

Back to the procedures for determining the correction scheme of the ink ejection timing, as shown in FIG. 8, the control unit 10 checks if the dispersion of the distribution of the number of ink drops to be ejected from the nozzles in the line head 110 of the ink color set as the correction color is not less than a predetermined threshold value (Step S128). When the dispersion is not less than the threshold value (YES in Step S128), the control unit 10 changes the ink color from the correction color to the reference color (Step S129). Note that this change is not made from the reference color to the correction color.

The reason why the ink color determined as the correction color is changed to the reference color when the dispersion of the distribution of the number of ink drops to be ejected from the nozzles in the line head 110 is not less than the threshold value is because of the following reason. Specifically, when the drop number distribution of the ink color set as the correction color is smaller than the drop number distribution of the ink color set as the reference color but exceeds a predetermined range, setting that color as the correction color could result in a problem similar to that caused when the ink color having a large drop number distribution is set as the correction color. In other words, the color tone may be significantly changed by the correction of the ejection timing in the other pixels on the same line without a color tone change of a superimposed color.

In the example shown in the graph of FIG. 9, for example, magenta having a large dispersion in the distribution of the number of ink drops to be ejected from the nozzles in the line head 110 is set as the reference color, and cyan having a small dispersion is set as the correction color for correction of the ejection timing. This is because, as described above, when magenta having a large dispersion is set as the correction color, rather than cyan having a small dispersion, the color tone of the entire line is significantly changed by a color tone change caused in the pixels outside the region 620.

However, when an absolute value of the dispersion of the drop number distribution of cyan is close to that of magenta, even if the dispersion of cyan is smaller than that of magenta, a color tone change in a degree close to that when magenta is set as the correction color occurs in the pixels outside the region 620. When the degree of the color tone change exceeds an acceptable range, the ink ejection timing from the nozzles in the line head 110 of cyan should not sometimes be corrected using cyan as the correction color even if the dispersion of cyan is smaller than that of magenta.

For this reason, in a relationship with the ink of the other color included in a superimposed color, even when the ejection drop number is larger or the drop number distribution dispersion is smaller than that of the ink of the other color in the pixels with a color tone change (the pixels in the region 620), that ink color is set as the reference color rather than the correction color when the size of the dispersion exceeds a predetermined range.

Such a change from the correction color to the reference color may be performed for only one correction color, or may be performed for some of or all of multiple correction colors. Therefore, by the change from the correction color to the reference color, all the ink colors included in a superimposed color can be set as the reference colors or some of the ink colors can be set as the reference colors and the other ink colors can be set as the correction colors.

For the color determined as the correction color by the above procedures, the ink ejection timing is corrected uniformly with the same scheme for all the nozzles in each line. Thus, a color tone change of the superimposed color can be inhibited while keeping good balance between the suppression of a color tone change in the pixels within the region 620 and a color tone change caused in the pixels outside the region 620. Note that Steps S128 and S129 may be omitted.

After determining the reference color and the correction color as described above, the control unit 10 calculates (a correction value of) the ejection timing to eject the ink of the correction color (correction target color) onto the pixels in the portion needing the landing position shift correction, and then stores the calculated timing in the RAM 92 or the external storage 93 for use in actual printing (Step S130). The (correction value of) ink ejection timing for the pixels is calculated based on the correction profile data corresponding to the numbers of the C (cyan), K (black), M (magenta) and Y (yellow) ink drops to be ejected onto those pixels.

To be more specific, for the ink color set as the reference color and the ink color set as the correction color in Step S126 or S127, a relative landing position shift amount of each correction color with respect to the reference color is obtained based on a landing position shift amount with respect to the ideal landing position defined in the correction profile data in the external storage 93. Then, a correction value of ejection timing required to correct the obtained relative landing position shift amount is calculated as a value to be stored in the RAM 92 or the external storage 93 in Step S130.

For a line in the main scanning direction X including pixels on which six drops of magenta ink and two drops of cyan ink land, for example, when magenta is determined as the reference color and cyan as the correction color, correction profile data on a combination pattern including six drops of magenta and two drops of cyan is referred to. Then, a correction value of ejection timing of the cyan ink, which is required to allow cyan to land at the same position as that of magenta, is calculated from a landing position shift amount of magenta and cyan with respect to the ideal landing position defined in the correction profile data.

Thereafter, in actual printing, the control unit 10 allows the ink of the correction color to be ejected onto the pixels in one line in the main scanning direction X including the pixels in the portion needing landing position shift correction by applying the correction value of ejection timing stored in the RAM 92 or the external storage 93 in Step S130. Thus, a color image in a print job inputted from the client terminal 14 is actually printed (print-outputted) in a state where a landing position shift in the correction target region is corrected (Step S131).

As described above, according to the ink jet printer 1 of this embodiment, the correction profile data having specified correction value of ink ejection timing is generated for each combination pattern of the numbers of drops of the respective ink colors, based on the detail of landing position shift of the pixels calculated by reading a print image of a test pattern for each drop number by the scanner 101.

Then, the region 620 with a notable color tone change is extracted by comparing image data obtained by the scanner 101 reading the color image 600 from the print sheet S having the color image 600 test-printed thereon with image data on the color image 600 in the print job. Furthermore, the reference color exempted from the ink ejection timing correction and the correction color subjected to the correction are determined based on the number of ink drops to be ejected onto the pixels in the region 620 and the drop number distribution dispersion of the ink to be ejected onto the pixels on one line in the main scanning direction X including the pixels in the region 620.

For the determined correction color, a correction scheme of relative ejection timing of the correction color with respect to the reference color is calculated from the correction profile data corresponding to the combination of the numbers of ink drops to be ejected onto the pixels in the region 620. Then, in actual printing of the color image 600, the ejection timing of the correction color for the pixels in one line including the pixels in the region 620 is uniformly corrected with the calculated correction scheme.

Thus, even when the ink ejection timing is corrected with the same correction scheme for the pixels on one line, this correction can inhibit a landing position shift between the ink colors included in a superimposed color, which might result in a color tone change of the superimposed color. Moreover, also for the other pixels on the same line with no color tone change of the superimposed color, a large color tone change due to correction of the ejection timing can be prevented.

Accordingly, a color tone change of a superimposed color in color printing due to a landing position shift can be inhibited by uniformly correcting the ejection timing for each line without individual control on ink ejection for each of the nozzles of each color.

Note that, as described above, for the reference color exempted from the ink ejection timing correction, a color having a smaller drop number is suitable among the multiple colors of ink to be ejected onto the pixels in the correction target region, and a color having a larger drop number distribution and larger dispersion in the line including the pixels in the correction target region is suitable.

Therefore, as in the example shown in FIGS. 4A to 4C described above, when the ink having the smaller number of ink drops to be ejected onto the pixels in the region 620 and the ink having a larger drop number distribution width (or distribution dispersion) on the line including the pixels in the region 620, between the cyan and magenta inks to be ejected in the region 620 that is the correction target region, are both the same color (magenta), the reference color and the correction color can be smoothly determined.

Meanwhile, for example, when the number of drops (the minimum number of drops) of cyan to be ejected in the correction target region is 2, the drop number distribution width is 1 (the drop number is 2 and 3), the number of drops (the minimum number of drops) of magenta is 3, and the drop number distribution width is 3 (the drop number is 3 to 6), cyan is suitable as the reference color by comparison of the drop number, and magenta is suitable as the reference color by comparison of the drop number distribution (or dispersion thereof).

In such a case, how to take into account the result of comparison of the drop number and the result of comparison of the drop number distribution (or dispersion thereof) to determine the reference color may be set based on a previously experimentally obtained result, for example.

In the embodiment described above, the image data obtained by reading the printed color image 600 from the print sheet S is used to extract eh region 620 with a notable color tone change as a target subjected to the ink ejection timing correction in the color image 600. However, the user may use the display 103 or the like, for example, to specify the region 620.

Furthermore, in this embodiment, when the size of the portion needing the landing position shift correction takes a certain value or more in ratio to the size of the print sheet S, the line heads 110 of the colors included in a superimposed color formed in the portion are determined as the correction target heads (Step S121 in FIG. 8). However, regardless of the size of the print sheet S, when the portion needing the landing position shift correction has a certain size or more, the line heads 110 of the colors included in a superimposed color formed in the portion may be determined as the correction target heads.

Moreover, in the embodiment described above, the description has been given by taking, as an example, the ink jet printer 1 configured to perform full-color printing using three chromatic colors, M (magenta), Y (yellow) and C (cyan), besides K (black). However, the present invention is widely applicable to image forming apparatuses configured to perform ink-jet color printing by superimposing at least two colors of ink.

An image forming apparatus in accordance with some embodiments (for example, a line ink jet printer 1 in FIG. 1) includes: line heads for respective colors arranged in a sub-scanning direction (for example, a sub-scanning direction Y in FIG. 3A), each of the line heads (for example, line heads 110 in FIG. 3A) having a plurality of nozzles arranged in a main scanning direction (for example, a main scanning direction X in FIG. 3A) perpendicular to the sub-scanning direction, and configured to allow ink ejected from corresponding nozzles to superimposedly land on a print sheet (for example, a print sheet S in FIG. 2) conveyed in the sub-scanning direction to form a color image (for example, a color image in FIG. 4A) on the print sheet; a drop number acquisition unit (for example, Step S122 in FIG. 8) configured to acquire a minimum drop number of ink (for example, a minimum number of ink drops to be ejected onto a portion needing a landing position shift correction acquired in Step S122 in FIG. 8; for example, a minimum number of drops of cyan=4 and a minimum number of drops of magenta=1 in a region 620 in FIG. 4C (see FIGS. 4B and 9)) ejected in a region (for example, a region 620 in FIG. 4C) with a color tone change within the color image formed on the print sheet, for each line (for example, each line head 110 in FIG. 3A) and for each color of the ink ejected in the region, based on an image data of the color image; a distribution acquisition unit (for example, Step S122 in FIG. 8) configured to acquire a drop number distribution of the ink (for example, a drop number distribution width of cyan=1 and a drop number distribution width of magenta=5 in a region 620 in FIG. 4C (see FIGS. 4B and 9)) ejected on a line belonging to the region, for each line and for each ink color, based on the image data; a classification unit (for example, Steps S123 to S128 in FIG. 8) configured to classify ink colors of ink to be superimposedly ejected in the region into a reference color (for example, magenta in FIG. 9) exempted from ejection timing correction and a correction color (for example, cyan in FIG. 9) subjected to the ejection timing correction, for each line, based on information on comparison between the acquired minimum drop numbers of the ink colors (for example, a result of a comparison between minimum numbers of ink drops of ink colors to be ejected onto pixels in a portion needing a landing position shift correction acquired in Step S122 in FIG. 8) and information on comparison between the acquired drop number distributions of the ink colors (for example, a result of a comparison of a drop number distribution between the colors performed in Step S124 in FIG. 8); a correction scheme acquisition unit (for example, Step S130 in FIG. 8) configured to acquire a correction scheme of the ink ejection timing of the correction color in the region, for each line; and a correction unit (for example, Step S131 in FIG. 8) configured to correct the ink ejection timing of the correction color in the region with the correction scheme acquired by the correction scheme acquisition unit, for each line.

According to the above configuration, when a color tone change of a superimposed color occurs due to a shift in ink landing position of the ink color included in the superimposed color, the landing position shift and the color tone change of the superimposed color caused by the shift can be inhibited by relatively adjusting the landing position of each ink color. In the case of adjusting the ink landing position by correcting the ink ejection timing, the problem is which one of the colors included in the superimposed color is set as the reference color exempted from the ejection timing correction and which color is set as the correction color subjected to the ejection timing correction to relatively adjust the landing positions of the both colors.

Meanwhile, in the above configuration, the ink ejection timing of the ink color determined as the correction color among the ink colors included in the superimposed color is corrected with the same correction scheme for each line in the main scanning direction. Therefore, when there are pixels with a color tone change of the superimposed color on a line, the ink ejection timing of the correction color is also uniformly corrected for the other pixels on the same line with the correction scheme corresponding to the number of ink drops of each color in the pixels with a color tone change of the superimposed color.

Here, it is assumed as an example that, for all the pixels on each line in a region with a color tone change, the ink ejection timing is corrected with a correction scheme corresponding to the numbers of ink drops of the reference color and a correction color ejected onto the pixels in the region on each line. In this case, for pixels other than the pixels with a color tone change of the superimposed color, the number of drops of the correction color corrected with the correction scheme of the ejection timing applied to the pixels differs from the number of drops of the correction color to be ejected from the nozzles onto the pixels. Also, as the difference in the number of drops becomes larger, the degree of a color tone change of the other pixels due to the correction of the ink ejection timing of the correction color becomes larger.

Moreover, when the ink color with a large drop number distribution on a line is set as the correction color, more pixels with a large difference in the drop number described above are included in the other pixels. Therefore, when the ink ejection timing of the correction color is corrected with the same correction scheme for each line as in the example described above, it is preferable that, among the ink colors included in superimposed color, the ink color with a relatively small drop number distribution on the line be set as the correction color.

Furthermore, when the ink landing positions are adjusted by correcting the ink ejection timing, the ink with a large drop number is less likely to be influenced by the airflow around the nozzles than that with a small drop number. Thus, the ink landing positions can be surely adjusted for the ink with a large drop number. For this reason, it is advantageous that, among the ink colors included in a superimposed color, the ink color with a smaller minimum drop number be set as the reference color and the ink color with a larger minimum drop number be set as the correction color.

The ink colors are classified according to inter-color comparison information on the minimum drop number of the ink ejected onto the pixels in the region with a color tone change and inter-color comparison information on the drop number distribution of the ink ejected onto the pixels in a line including the pixels. Then, the ink color to be set as the reference color and the ink color to be set as the correction color are determined based on the classification result. Thus, even when the ink ejection timing is corrected with the same correction scheme for the pixels on each line, this correction can inhibit a landing position shift between the ink colors included in superimposed color, which would result in a color tone change of superimposed color. Moreover, also for the other pixels on the same line with no color tone change of the superimposed color, a large color tone change due to correction of the ejection timing can be prevented.

Accordingly, a color tone change of a superimposed color in color printing due to a landing position shift can be inhibited by uniformly correcting the ejection timing for each line without individual control on ink ejection for each of the nozzles of each color.

The classification unit may be configured to determine an ink color with the smallest minimum drop number (for example, magenta with the small number of drops being one in the region 620 in FIG. 4C; see FIGS. 4B and 9) as the reference color and determine the other ink color (for example, cyan with the small number of drops being four in the region 620 in FIG. 4C; see FIGS. 4B and 9) as the correction color (for example, Step S126 in FIG. 8).

According to the above configuration, when one of the ink colors included in the superimposed color is set as the reference color, the ink color with the smallest minimum drop number, which is most difficult to be adjusted for ink landing position by correction of ejection timing, is set as the reference color exempted from the ejection timing correction. Accordingly, the ink color which is easily adjusted for ink landing position by correction of ejection timing is proactively set as the correction color. Thus, a color tone change of the superimposed color due to ink landing position shift can be efficiently inhibited.

When there are a plurality of ink colors with the smallest minimum drop number (for example, YES in Step S125 in FIG. 8), the classification unit may be configured to determine an ink color with the largest drop number distribution as acquired among the plurality of ink colors with the smallest minimum drop number as the reference color, and determine the other ink color as the correction color (for example, Step S127 in FIG. 8).

According to the above configuration, when one of the ink colors included in the superimposed color is set as the reference color, the ink color having the largest drop number distribution is set as the reference color exempted from the ejection timing correction. More specifically, the ink color to be set as the reference color is likely to have a large unnecessary color tone change in pixels other than the superimposed color with a color tone change, among the ink colors having the smallest minimum drop number, which are most difficult to be adjusted for ink landing position by correction of ejection timing. Accordingly, the ink color easily adjusted for ink landing position by correction of ejection timing or the ink color less likely to have a large unnecessary color tone change in pixels other than the superimposed color with a color tone change by correction of ejection timing with the same correction scheme is proactively set as the correction color. Thus, a color tone change of the superimposed color due to ink landing position shift can be efficiently inhibited.

When the acquired drop number distribution of the ink color determined as the correction color exceeds a predetermined range, the classification unit may be configured to change the determination with respect to the ink color determined as the correction color from the correction color to the reference color (for example, Steps S128 and S129 in FIG. 8).

According to the above configuration, in consideration of the fact that, when the drop number distribution of the ink color set as the correction color exceeds the predetermined range, it is preferable that the ink color having a relatively small drop number distribution on the line, among the ink colors included in a superimposed color, be set as the correction color, this ink color is changed from the correction color to the reference color and is thus exempted from the ink ejection timing correction. Thus, a color tone change of the superimposed color can be inhibited while keeping balance with a color tone change caused in the other pixels by uniformly correcting the ink ejection timing with the same scheme for all the nozzles in each line.

The drop number acquisition unit may be configured to acquire the minimum drop number when the region has a predetermined size or more, and the distribution acquisition unit may be configured to acquire the drop number distribution when the region has the predetermined size or more (for example, Step S121 in FIG. 8).

When the ink ejection timing is corrected uniformly with the same scheme for all the nozzles in each line to suppress a color tone change of a superimposed color, a new color tone change may occur in the other pixels. Meanwhile, when a region with a color tone change of the superimposed color has a size (smaller than a predetermined size) that makes a color tone change visually unnoticeable within the whole color image, there is sometimes no need to correct the ink ejection timing even though there is a color tone change of the superimposed color.

When the size of the region with a color tone change of a superimposed color is smaller than the predetermined size, the minimum drop numbers or drop number distributions for each line of the ink colors included in the superimposed color are not acquired. As a result, the ink ejection timing is no longer corrected for the pixels on the line including the pixels with the color tone change of the superimposed color. Thus, when a color tone change of the superimposed color occurs only in a visually unnoticeable degree, the ink ejection timing is not corrected and thus a color tone change can be prevented from occurring in the other pixels.

A ratio of the predetermined size or more to a size of the print sheet may take a certain value or more (for example, Step S121 in FIG. 8).

According to the above configuration, the size that makes a color tone change of a superimposed color visually unnoticeable can be set to be an appropriate size in accordance with the size of (the color image formed on) the print sheet.

The image forming apparatus may further include: an image data acquisition unit configured to read the color image formed on the print sheet and acquire image data for each of ink colors of the color image as read (for example, Step S112 in FIG. 7); and a region specification unit configured to specify the region based on the acquired image data (for example, Step S113 in FIG. 7).

According to the above configuration, a region with a color tone change of a superimposed color of the color image formed on the print sheet is objectively specified, and ink ejection timing adapted to the color tone change of the superimposed color can be acquired.

According to the above configuration, a color tone change of a superimposed color in color printing due to a landing position shift can be inhibited without individual control on ink ejection for each of the nozzles of each color.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An image forming apparatus comprising:

a first line head comprising a first plurality of nozzles to eject a first ink color;

a second line head comprising a second plurality of nozzles to eject a second ink color, the first and second line heads being arranged in a sub-scanning direction, the first and second plurality of nozzles being arranged in a main scanning direction perpendicular to the sub-scanning direction;

a single drive circuit configured to drive all of the first plurality of nozzles with a first ejection timing, and to drive all of the second plurality of nozzles with a second ejection timing, the first and second line heads configured to allow the second ink color ejected from the second plurality of nozzles to superimposedly land on the first ink color ejected onto a print sheet conveyed in the sub-scanning direction to form a color image on the print sheet; and a processor configured to:

acquire, using a scanner, for each line and for each of the first ink color and the second ink color ejected in the region, a minimum drop number of ink ejected in a region with a color tone change within the color image formed on the print sheet based on image data of the color image;

acquire, using the scanner, for each line belonging to the region and for each of the first and second ink colors, a drop number distribution of the first and second ink colors ejected based on the image data;

classify, for each line belonging to the region, the first ink color and the second ink color that are to be superimposedly ejected as either a reference color exempted from an ejection timing correction or a correction color subjected to the ejection timing correction, the classification being based on a comparison between the acquired minimum drop numbers of each of the first and second ink colors and a comparison between dispersions of the acquired drop number distributions of the first and second ink colors;

acquire, for each line belonging to the region, a correction scheme of the ink ejection timing of the correction color; and correct the ink ejection timing of the correction color in the region with the correction scheme for all pixels on each line.

2. The image forming apparatus according to claim 1, wherein the processor is further configured to determine an ink color, from among the first and second ink colors, with the smallest minimum drop number as the reference color, and determine a remaining ink color as the correction color.

3. The image forming apparatus according to claim 1, further comprising:

a third line head comprising a third plurality of nozzles to eject a third ink color, wherein when both the first and second ink colors have the smallest minimum drop number among the first, second, and third ink colors, the processor determines an ink color with the largest drop number distribution, from among the first and second ink colors, and determines the third ink color as the correction color.

4. The image forming apparatus according to claim 2, wherein when the acquired drop number distribution of an ink color determined as the correction color exceeds a predetermined range, the processor changes the determination with respect to the ink color determined as the correction color from the correction color to the reference color.

5. The image forming apparatus according to claim 1, wherein the processor is further configured to acquire the minimum drop number and the drop number distribution when the region has a predetermined size or more.

6. The image forming apparatus according to claim 5, wherein a ratio of the predetermined size or more to a size of the print sheet takes a certain value or more.

7. The image forming apparatus according to claim 1, wherein the processor is further configured to: read the color image formed on the print sheet and to acquire the image data for each of the first and second ink colors of the color image as read; and specify the region based on the acquired image data.

8. The image forming apparatus according to claim 1, wherein each of the first plurality of nozzles of the first line head has a same ejection timing as an adjacent nozzle of the first line head, and each of the second plurality of nozzles of the second line head has a same ejection timing as an adjacent nozzle of the second line head.

* * * * *